United States Patent [19]

White, Jr.

[11] 4,357,133

[45] Nov. 2, 1982

[54] ROTARY GEROTOR HYDRAULIC DEVICE WITH FLUID CONTROL PASSAGEWAYS THROUGH THE ROTOR

[76] Inventor: Hollis N. White, Jr., 707 Tamiami Trail, West Lafayette, Ind. 47906

[21] Appl. No.: 113,400

[22] Filed: Jan. 18, 1980

Related U.S. Application Data

[63] Continuation of Ser. No. 910,075, May 26, 1978, abandoned.

[51] Int. Cl.[3] ..... F03C 2/08; F04C 2/10; F04C 15/02

[52] U.S. Cl. ..... 418/61 B; 418/186

[58] Field of Search ..... 418/61 B, 186–188; 73/255, 256

[56] References Cited

U.S. PATENT DOCUMENTS

| | | | |
|---|---|---|---|
| 211,769 | 1/1879 | Nash | 418/61 B |
| 2,989,951 | 6/1961 | Charlson | 418/61 B |
| 3,233,524 | 2/1966 | Charlson | 418/61 B |
| 3,825,376 | 7/1974 | Petersen et al. | 418/61 B |
| 3,876,343 | 4/1975 | Giversen | 418/61 B |

FOREIGN PATENT DOCUMENTS

| | | | |
|---|---|---|---|
| 2354573 | 5/1975 | Fed. Rep. of Germany | 418/61 B |

*Primary Examiner*—John J. Vrablik

*Attorney, Agent, or Firm*—Woodling, Krost & Rust

[57] ABSTRACT

A rotary fluid pressure device is disclosed comprising a housing having fluid inlet and outlet means and enclosing a gerotor having an internally toothed member and a coacting externally toothed member having a less number of teeth than the internally toothed member and having its axis positioned eccentrically relative to the axis of the internally toothed member. A wobble stick in the housing has a first end connected to the axial drive shaft and a second end connected to the gerotor member having the orbital movement. The housing has one set of passageways communicating at all times with the expanding and contracting gerotor cells. The gerotor member having orbital movement is, in addition to its usual function, a valve with two travel passageways, one travel passageway extending straight through the rotor and coaxially surrounding the other travel passageway. These two travel passageways communicate at all times part of the set of passageways in the housing with only one fluid inlet or outlet while communicating other of this same set of passageways with the other fluid inlet and outlet.

49 Claims, 14 Drawing Figures

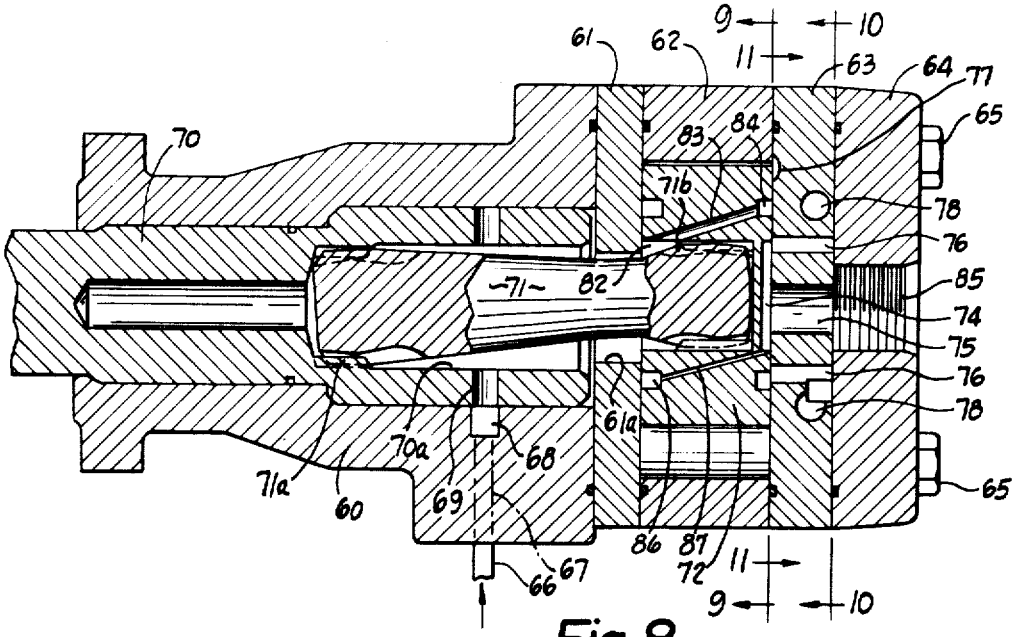
Fig. 8
Fig. 9
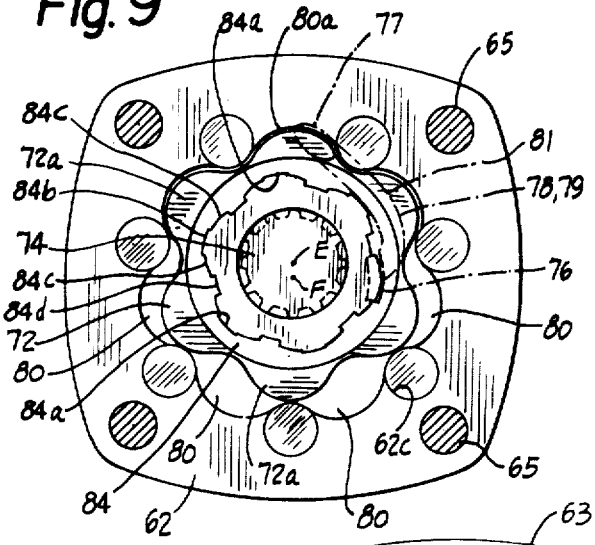
Fig. 10
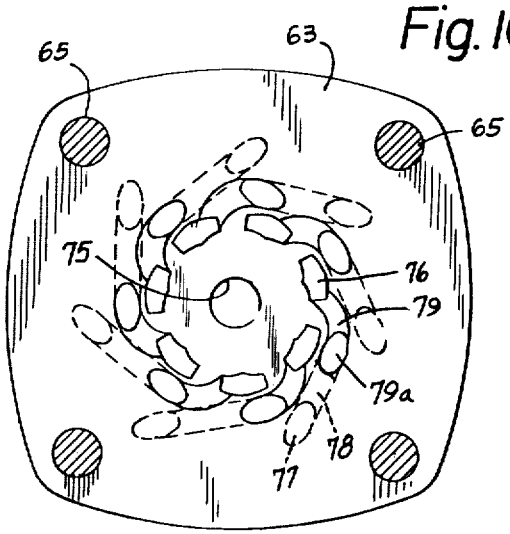
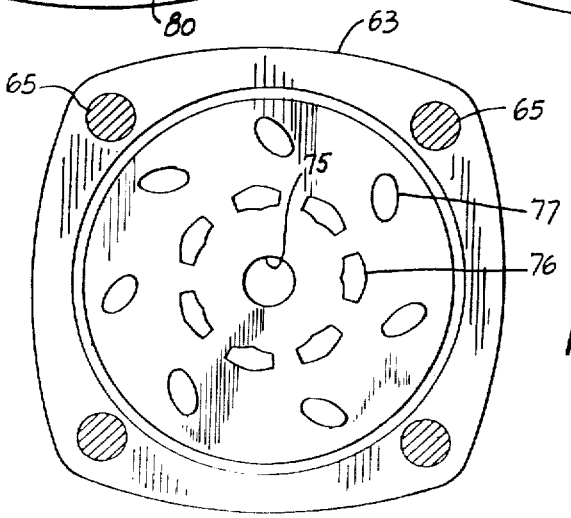
Fig. 11

ROTARY GEROTOR HYDRAULIC DEVICE WITH FLUID CONTROL PASSAGEWAYS THROUGH THE ROTOR

This is a continuation of application Ser. No. 910,075, filed May 26, 1978, now abandoned.

An object of this invention is to provide a rotary fluid pressure device including a gerotor having a fixed stator inside of which is an orbiting and rotating rotor. The rotation of the orbiting rotor member provides the output or input at the shaft member. This rotor has a continuous ring valve on one side and both of the supplies of intake and exhaust pressure fluid are on the opposite side. The second embodiment shows again a fixed stator with an orbiting rotor with the rotating component of the rotor used at the output shaft; but in this embodiment the intake is on the internal diameter of one side of the rotor member with balanced area grooves in communication with the first named intake and exhaust grooves on the oppposite side of the rotor so as to provide a hydraulically balanced rotor.

An added object of this invention is to provide a pressure loaded commutator ring urged with a wave spring for initial contact, together with a drive pin connected between the rotor and the commutator ring.

Another object of the invention is to provide a pressure loading plate in the end cover of the housing so as to cause a pressure balance providing a head force towards the manifold and gerotor set.

The present invention reduces the number of manufacturing operations necessary to make hydraulic pressure devices. The devices made in accord with this invention are simple, reliable and efficient.

Another object of this invention is to provide a hydraulically balanced rotor.

Still another object is to reduce the wear of and cool the wobble stick drive connections.

Other objects and advantages of the present invention will be apparent from the accompanying drawings and the description. The essential features will be set forth in the appended claims.

BRIEF DESCRIPTION OF THE DRAWINGS

FIG. 8 is a central sectional view through the second embodiment of this invention;

FIGS. 9, 10 and 11 are respectively sectional views taken along the lines 9—9, 10—10 and 11—11 of FIG. 8;

FIG. 12 is a fragmental sectional view taken at the righthand end of FIG. 1 and showing a pressure loading plate in the end cover; while

DESCRIPTION OF PREFERRED EMBODIMENT

Those familiar with this type of apparatus will understand that while the present invention is being described as a pump using a fluid inlet and a fluid outlet, nevertheless, the same structure may be used as a motor by merely reversing the fluid inlet and outlet so that the high pressure fluid now enters at what was previously the inlet and the device operates as a motor.

In the description and claims occurring hereinafter, the term "housing" is used to include not only the main housing member but also the pressure plate, gerotor set, manifold and end cap, all of these latter parts being connected to the main housing portion by bolts.

Figure 1:
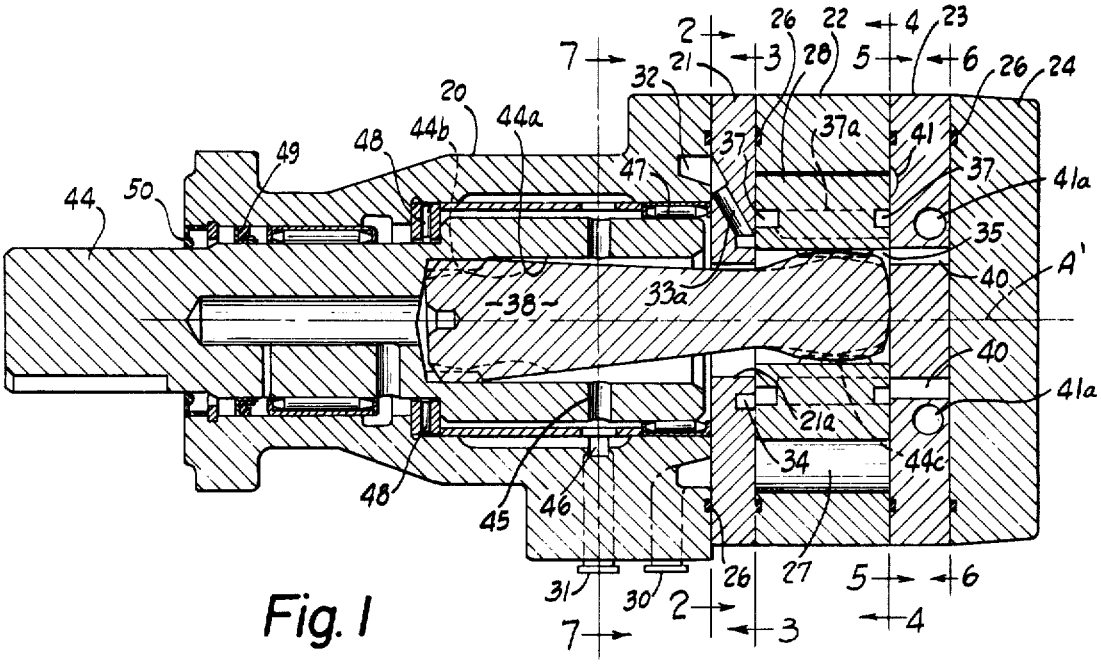
FIG. 1 is a central sectional view through the first embodiment of this invention.

Referring now to FIG. 1, the first embodiment of this invention comprises a main housing unit 20 having a radially flat inner end to which is respectively attached a wear plate 21, a gerotor set 22, a manifold 23 and an end cap 24, all of these being secured together by bolts 25, which are shown in the various sectional views but omitted from FIG. 1, but those skilled in this art will recognize that the bolts have heads pressing against the outer righthand end of the end cap 24 and extending through the members 21, 22 and 23 and threaded tightly into the main housing portion 20. Sealing rings 26 seal all of the members against leakage between them.

Figure 4:
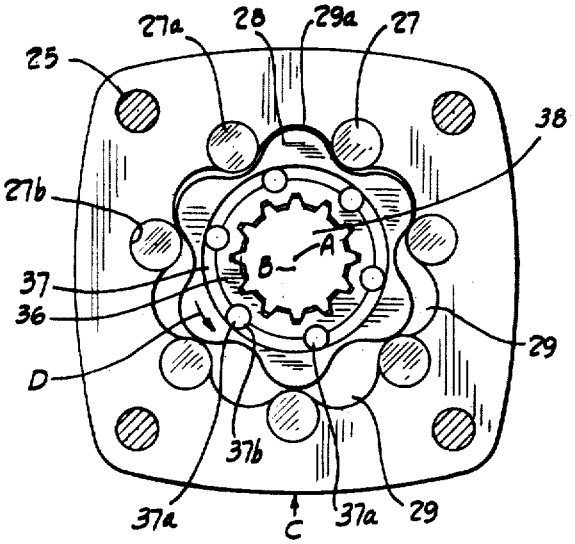
FIG. 4 is a sectional view taken along the line 4—4 of FIG. 1.

The gerotor set 22, best seen in FIGS. 1 and 4, comprises an internal toothed member 27 which is a stator inside of which a coacting externally toothed member 28, a rotor which rotates about its own axis A is seen in FIG. 4, but which is eccentric relative to the center of the stator 27 by the distance shown between A and B, on the line of eccentricity C, and the rotor orbits about the center B. During this movement of the rotor and stator a series of cells 29 and **29*a* from a series of cells of constantly changing size between the rotor and stator, the size of the cells becoming greater on one side of the line of eccentricity, and the cell size becoming smaller on the opposite side. In FIG. 4 the minimum size cell at 29*a* approaches zero. The rotor rotates in the direction of the arrow shown in FIG. 4**. The rotor has two flat axial end surfaces.

The inlet means to the housing is indicated at 30. The fluid outlet means is shown at 31. The inlet means is connected by means indicated only in dot-dash lines through a continuous annulus or distribution channel 32 in the main housing portion 20. This annulus opens through the wear plate 21 which has a number of through openings or fluid travelway 33 the number of which is not important, but sufficient to take care of the flow of fluid necessary. These openings 33 are connected by connecting passages **33*a* to an annulus or annular ring transfer channel 34 of smaller diameter on the opposite face of the wear plate and opening into the rotor cavity toward the gerotor 22**.

The internal teeth **27*a* on the stator 27 are provided by cylinders 27*a* inserted in recesses 27*b* over 180° in circumference so as to maintain the cylinders 27*a* in the positions shown in FIG. 4. It will be understood that the cylinders 27*a* terminate at the level of the opposite faces of the stator 27. The rotor 28 has external teeth which are formed to fit almost exactly between the internal teeth of the stator, as shown in FIG. 4. The rotor 28 has an open center 35 surrounded by a sealing strip 36 which is uninterrupted circumferentially and laterally outside of which is an annular liquid intake passageway 37. The axis of rotation for the wobble stick 38 is marked A in FIG. 4. The axis of rotation for the orbiting movement of the wobble stick 38 relative to the stator is indicated at B in FIG. 4. The line C passing through A and B is herein indicated as the line of eccentricity. The movement of the rotor herein described is as indicated by the arrow D in FIG. 4. During this rotation the cells 29 on the lefthand side of the line of eccentricity increase in size gradually while the cells 29 on the righthand side of the line of eccentricity gradually decrease in size as indicated in FIG. 4. The rotor functions as the main valve for the device. Six travel passageways or holes 37***a* are evenly spaced around the annulus 37 extending linearly through the rotor parallel to the axis of the rotor. These project radially inwardly from the annulus or annular channels 37 as seen at 37*b*, in one embodiment this being about ⅛ of an inch projection. The other travel passageway is generally on the central axis of the rotor, in the structure disclosed around the wobble stick-rotor device connection. There are sufficient openings in this type of drive connection that fluid flow is relatively unimpeded by the spline-gear interfaces. The transfer channel 34 communicates with the annular channel as the device is operated.

Figure 5:
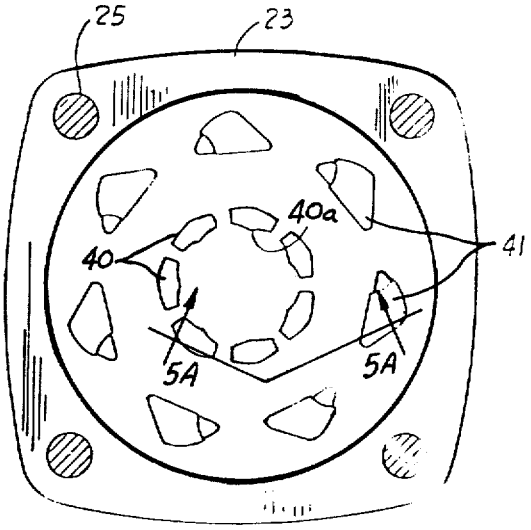
FIG. 5 is a sectional view taken along the line 5—5 of FIG. 1.
Figure 5A:
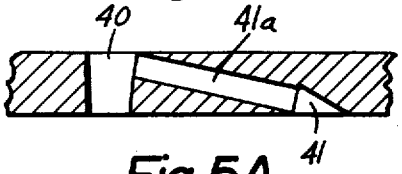
FIG. 5A is a fragmental sectional view taken along the line 5A—5A of FIG. 5.
Figure 6:
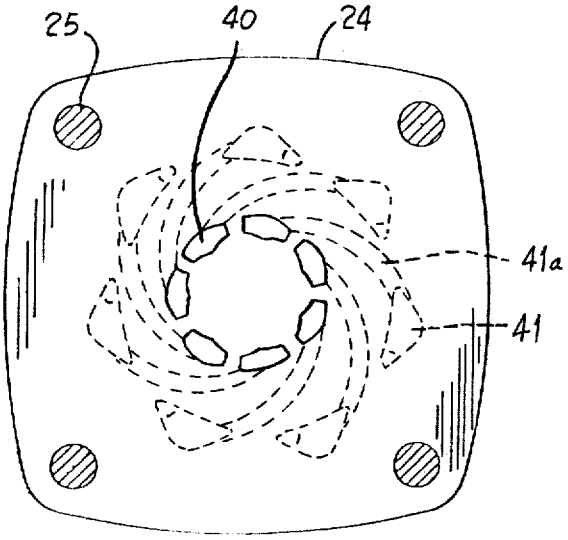
FIG. 6 is a sectional view taken along the line 6—6 of FIG. 1.
Figure 7:
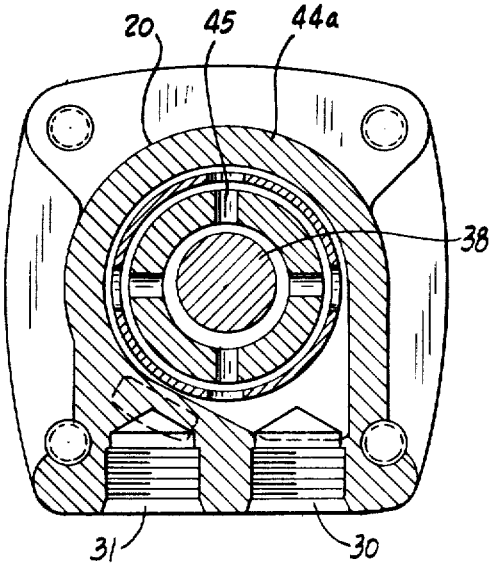
FIG. 7 is a sectional view taken along the line 7—7 of FIG. 1.

A manifold 23 connects the rotor valve with the gerotor cells. The manifold 23 will be best shown in FIGS. 5, 5A, and 6. Seven parallel through openings extend through rotor facing surface of the manifold 23 parallel to its axis. This set of openings, as best seen in FIGS. 5 and 6, have a peculiar cross section. These openings 40 will be herein described as "double-trapezoidal". Referring to FIG. 5, it will be seen that one of these openings appears substantially like two trapezoids facing each other with no middle partition and having opposite ends which are not quite parallel but instead are radial. The radially inner side of each opening is composed, not of straight lines, but of lines slightly concave inwardly meeting in a slight peak at the center 40*a*. The outer wall of this opening radially, as seen in FIG. 5, may be composed of two straight lines meeting in the center or preferably a single line slightly convex radially outwardly. The size of each of these openings is such as to fit in the opening, seen in FIG. 4, between two of the cylindrical openings 37*a* in a circumferential direction and between the central opening and the annulus 37 in a radial direction. These openings 40 are swept by the travel passageways in the rotor as the device is operated. This performs the primary valving function of the device. Each of the openings 41, as seen in FIGS. 5 and 6, of which there are seven evenly spaced, on the side of the manifold toward the gerotor are connected by fluid passageways 41*a* sloping inwardly and downwardly to one of the openings 40 just described.

The manifold 23, as seen in FIG. 6, shows seven inclined passageways 41*a* in broken lines which coact with the structure described in connection with the openings 41 and openings 40 as previously described. These coacting passageways are shown in broken lines in FIG. 6 to show the cooperation. Seven of such passages 41*a* are provided extending part way through the manifold from side to side. These are at a slight angle to the axis of the gerotor and are spaced at a diameter to register, as shown in FIGS. 5 and 6.

Figure 2:
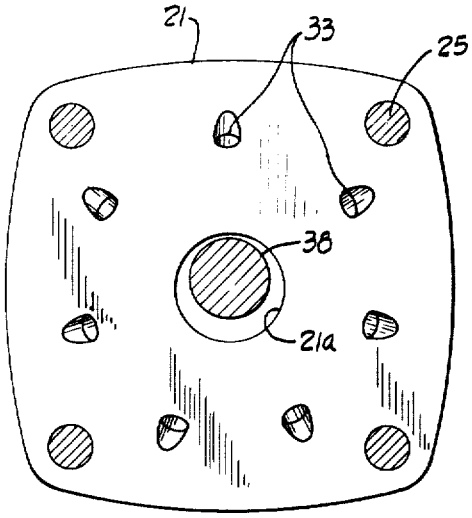
FIG. 2 is a sectional view taken along the line 2—2 of FIG. 1.
Figure 3:
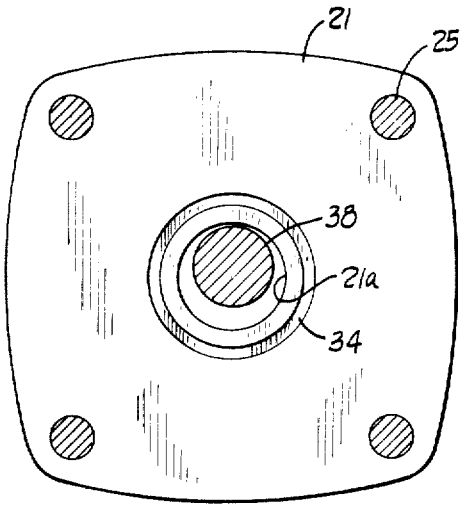
FIG. 3 is a sectional line taken along the line 3—3 of FIG. 1.

The elongated rigid wobble stick 38 is clearly seen in FIG. 1 and shown in section in FIGS. 2 and 3. One end of the wobble stick has a spline connection 44*b* with the drive shaft 44. It will be noted that this shaft has a solid outer end and a hollow inner end as indicated at 44*a*. The opposite end of the wobble stick has a spline connection 44*c* in a central bore in the rotor 28. These spline connections are provided in such a manner that the wobble stick may rotate and orbit around the center axes A, B, and that fluid can continuously flow over and around them. The exhaust passageway includes the open center 35 of the rotor over and around the wobble stick-rotor drive connection and the open center 21*a* of the wear plate and the hollow 44*a*, and is completed by four radial passageways 45 and 46 which are connected, as shown in dot-dash lines, with the outlet 31.

Suitable needle bearings are shown at 47 and 48 supporting the drive shaft 44 in the main housing portion 20. Also suitable sealing means as shown at 49 and 50 are provided where the drive shaft passes out of the main housing portion 20.

This embodiment has been described as a pump utilizing the drive shaft 44 for the attachment of power which would cause intake of lower pressure fluid at 30 and exhaust of higher pressure fluid at 31. As previously explained, reversing the connections 30 and 31 will cause the device to operate as a motor producing power on the drive shaft 44.

The operation of the first embodiment as a pump will now be described. Power is supplied to the protruding left end of the drive shaft 44 as seen in FIG. 1. This rotates the shaft, the wobble stick 38, the rotor 28, and also causes the rotor to orbit about the stator 27. This causes the cells 29 to the left of the line of eccentricity C to gradually increase in size causing a suction at the intake 30. The cells 29 on the righthand side of the line of eccentricity C in FIG. 4 are also caused to progressively decrease in size thus causing the fluid under increased pressure to exhaust at the outlet 31. The incoming fluid from intake 30 passes through the annular channel 32, the passageways 33*a* to the annular channel 34, then through the rotor 28 through the annular channels 37 and the cylindrical holes 37*a*, then through the double trapezoidal openings 40 in the manifold 23, then through the passageways 41*a* and 42 in the manifold and through the openings 41 in the manifold and rotor and thus into the expanding cells 29. Other cells 29 are exhausted back through other openings 41 and other passageways 42 and 41*a* and other double trapezoidal openings 40 in the manifold into the open center 35 of the rotor. The fluid then flows over and around clearances in the wobble stick-rotor drive connection, cooling and lubricating it, through the opening 21*a*, through the hollow portion 44*a* of the shaft and through openings 45 and 46 and thus out through the outlet 31.

The second embodiment of this invention is shown in FIGS. 8, 9, 10 and 11. FIG. 8 is a central sectional view through the second embodiment with the bearings and seals resembling those seen in FIG. 1 omitted for simplication of the drawings.

The main housing portion 60 has secured to it a wear plate 61, a gerotor set 62, a manifold 63, and an end cap 64, all secured rigidly together by a plurality of bolts 65 extending from the righthand end of the device as seen in FIG. 8 into threads in the main housing portion 60. The main housing portion has an air intake 66 connected by a passage 67 through the housing portion 60 with a continuous annulus chamber 68, which communicates with a plurality of radial openings 69 which lead inwardly to a hollow portion 70*a* of a drive shaft 70 which is rotatably mounted in the housing portion 60.

An elongated rigid wobble stick 71 has a spline connection 71a at one end with the drive shaft 70 and another spline connection 71b at the opposite end with the rotor member of the gerotor set 62. The spline connections 71a and 71b are so shaped as to permit the rotation of the wobble stick while at the same time permitting it to follow the orbiting movement of the rotor in the stator as will presently appear.

The wear plate 61 has a circular opening 61a which permits the necessary movement of the wobble stick 71 and at the same time forms part of the intake passageway for fluid.

Six pairs of intake passageways 82 and 83 extending through the rotor 72 connecting the circular opening 61a in the wear plate 61 with the annular passageway 84. The annular passageway 84 opens towards the manifold 63.

The gerotor 62 is best seen in FIG. 9. It comprises a stator 62a which has a plurality of internally extending teeth formed partly by direct formation in the stator but also in part by six cylindrical members 62b which are firmly held in recesses 62c which extend for a distance greater than the diameter of each of the cylinders 62b so that they are held firmly in the position shown in FIG. 9. A rotor 72 is shown having a plurality of externally extending teeth 72a which are shaped to fittingly coact with the internally extending teeth 62, 62a and 62b, these external teeth being one less in number than the internal teeth previously described. The rotor has an axis E which is eccentric relative to the axis F of the stator and the line G passing through points E and F is herein designated as the line of eccentricity. The rotor is provided with a generally annular ring 73 forming part of the intake passageway for fluid. This passageway is concentric around the axis E. Inside the annular ring 73 is a circular opening 74, also concentric, for the exhaust of fluid from the rotary fluid pressure device.

Referring now to FIGS. 9, 10 and 11, FIG. 11 shows the face of the manifold toward the gerotor structure 62. Centrally there is the exhaust opening 75 which communicates with the exhaust opening 74. In the next circle, and concentric, are seven rotor communicating openings 76, and in an outer concentric circle are seven passageway openings 77 so positioned that they cooperate circumferentially with the cells 80 which are formed in changing fashion between the rotor and the stator as seen in FIG. 9.

FIG. 10 shows the face of the manifold 63 toward the end cap 64. This shows the through passageways 76 each connected to one of the openings 77 by means of angular passageways 78 and 79, each pair of which joins at an opening 79a.

The cooperation of these parts is shown in dot-dash lines in FIG. 9 at 81. This shows one of the openings 77 in position to cooperate with a cell 80a at the top of FIG. 9 and it is in cooperation through passageways 78 and 79, here shown diagrammatically, with one of the openings 76, which you might say is about two and one-half positions away going around the circle. It will now be seen how the radially outward openings 84a in the annular ring 84 cooperate with the communicating passageways 76. There are six of the formations 84a and each comprises a central, radially outermost portion 84b which extends substantially circumferentially and at each end of this outermost portion is a radially and circumferentially inwardly sloping portion 84c which extends to a radially innermost separating portion 84d. Each of the passageways 76 is herein described as double trapezoidal in section inasmuch as the opposite halves of the section are approximately trapezoid with their wider edges opening toward each other in the center. It will now be seen in FIG. 9. that when the dead pocket 80a at the top of FIG. 9 is in communication with its associated opening 77, then the other end of the connection through the 78, 79 connection and shown at 76 in dot-dash lines will illustrate how the exhaust pocket related to cell 80a is shut off before the fluid is transferred from the associated intake pocket 76. This gives the dead center pocket a higher pressure than the supply at 66 because the fluid is trapped at that particular moment. This higher pressure causes the rotor 72 to seal better against the cylindrical members 62b on the opposite side of the axis. This higher pressure in cell 80a also provides oil to the pivot roll near the upper dead center in FIG. 9 whereby the rotor floats on a hydrodynamic oil film thus giving a higher mechanical efficiency output. It will now be seen that the shape of each of the portions 84a of the annular ring 84 match fairly well with the radially outer edges of the double trapezoidal passageways 76.

A balancing ring 86 is on the opposite side of the rotor from the annular ring 84. Small passages 87 through the rotor connect the balancing ring 86 to the opening 74. The balancing ring 86 equalizes the hydraulic pressure on the rotor 72.

It should now be apparent how the operation of this device as shown in FIGS. 8–11 operates. Power is applied to the shaft 70 causing the rotor 72 to rotate in the stator 62a in the direction of the arrow shown in FIG. 9. The intake flow is from the inlet 66 through passageways 67 and 68, then through the hollow shaft portion 70a and through the central opening 61a in the wear plate. Then the flow is through passageways 82 and 83 to the annular passageway 84 which opens toward the manifold 63. Then the flow passes through an opening to passageway 76 on one side of the eccentricity line G through the manifold passages 78, 79 to one of the openings 77 which is in communication with one of the cells 80 between the rotor and stator. Meanwhile, one of the cells 80 on the other side of the eccentricity line G communicates back to the appropriate passageway 76 and back through the manifold 63 to the exhaust passageways 74, 75 and 85 to exhaust.

Figure 12:
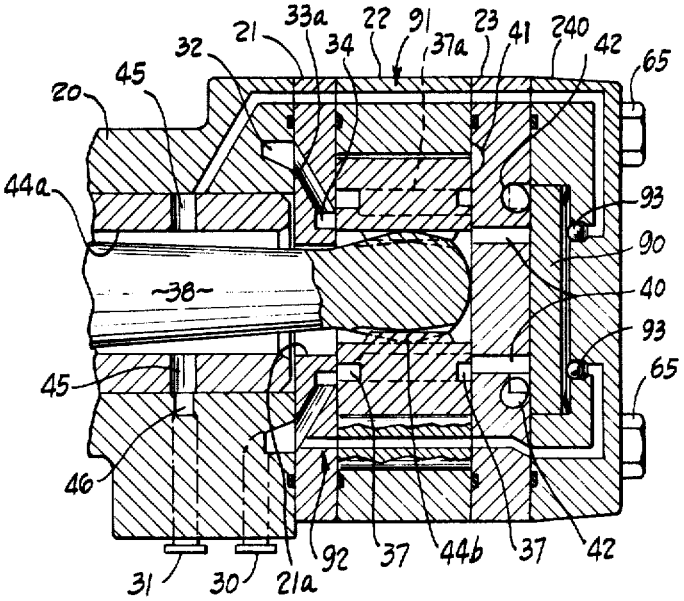

FIG. 12 shows a portion of the righthand end of FIG. 1 where the same parts are given the same reference numbers. Otherwise, the device operates as described in connection with FIG. 1. However, in FIG. 12 there has been added a pressure plate 90 inserted in a suitable recess in the end cap 240, and the end cap is pushed toward the left as viewed in FIG. 12 by means of pressure admitted through lines 91, connected with the exhaust 45, and line 92 connected with the intake 30. Each of the lines 91 and 92 has adjacent the pressure loading plate 90 a ball check valve 93 so that the loading plate 90 is always pressed inwardly toward the manifold 23 and the gerotor set 22 beyond it. This provides a head force towards the manifold and rotor set. This will take care of any wear between the engaging rubbing portions 22 and 23.

Figure 13:
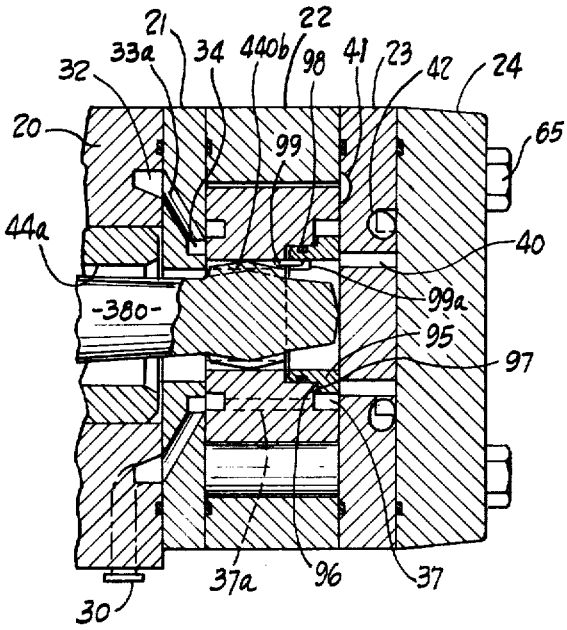
FIG. 13 is a fragmental sectional view taken at the righthand end of FIG. 1 and showing a pressure loaded commutator ring.

FIG. 13 also shows a portion of the righthand end of FIG. 1 and all of the same parts are given the same reference characters. The added feature here is a pressure loaded commutator ring 95 which extends inwardly, toward the left in FIG. 13, against a shoulder 96 with a wave spring 97 circular in shape and pressed between the commutator ring and the shoulder 96 to give an inicial pressure. The wave spring is made of spring metal which weaves back and forth from a generally common plane as one goes around the circle. A seal 98 prevents leakage between the parts. There is provided a pin connection 99 which as seen in FIG. 13 is in general an axial extension of the splines 440*b* connecting the wobble stick 380 and the rotor of the gerotor set 22. This pin fits between the splines 440*b* and extends into a suitable opening 99*a* in a portion of the commutator ring. This pin connection is somewhat loose so as to use the rotational component of the rotor as a means of timing the opening and closing of the connection indicated in dot-dash lines in FIG. 9.

Although this invention has been described in its preferred form with a certain degree of particularity, it is to be understood that the present disclosure of the preferred form has been made only by way of example and that numerous changes in the details and in the combination and arrangement of parts may be made without departing from the spirit and the scope of the invention as hereinafter claimed.

What is claimed is:

1. In a gerotor hydraulic pressure device having a housing, a rotor with two flat axial end surfaces, gerotor cells and two fluid connections, an improved fluid control comprising a pair of travel passageways, one of said pair of travel passageways extending on a straight line through the rotor from one surface to the other, the other of said pair of travel passageways being in the rotor, means to connect one of said pair of travel passageways to one of the fluid connections, means to connect the other of said pair of travel passageways to the other of the fluid connections and means within the housing to connect said pair of travel passageways to the gerotor cells selectively as the device is operated.

2. A rotary fluid pressure device as defined in claim 1, wherein the gerotor hydraulic pressure housing includes a manifold axially engaging against the gerotor and an end cap axially engaging said manifold on the side opposite the gerotor said means within the housing to connect said pair of travel passageways to the gerotor cells being manifold passageways in said manifold, means holding said end cap against said manifold, there being a pressure loading plate in a central recess in said end cap, said pressure loading plate forming a wall of said manifold passageways, an annular wave spring between said loading plate and said end cap, pressure fluid connections in said end cap communicating with the two fluid connections and check valves in said pressure fluid connections adjacent said pressure loading plate opening only toward said plate, whereby to exert a head force on said plate toward said manifold and the gerotor.

3. A rotary fluid pressure device as defined in claim 1, wherein the gerotor hydraulic pressure device includes a manifold axially engaging against said gerotor, the gerotor including a rotor having a concentric recess on the side toward said manifold, said recess having a larger diameter portion axially outermost and a smaller axially innermost portion, a flat radially extending shoulder joining said two portions, a commutator ring having larger and smaller diameter portions fitting snugly into said smaller diameter recess portion and spaced from said larger diameter recess portion and there providing a wall of one of said pair of travel passageways in the rotor, a seal between said smaller diameter of said commutator ring and said smaller diameter recessed portion in the rotor, an annular wave spring between said shoulder and the commutator ring, and a drive pin connection between said commutator ring and the rotor.

4. The structure of claim 1 characterized in that the other of said travel passageways extends through the rotor from one end surface to the other end surface.

5. In a gerotor hydraulic pressure device having a housing, a rotor with two flat axial end surfaces, gerotor cells, and two fluid connections, an improved fluid control comprising a pair of travel passageways, said pair of travel passageways being in the rotor, one of said pair of travel passageways extending through the rotor from one surface to the other, said one travel passageway being spaced from the axis of the rotor at both end surfaces of the rotor, said travel passageway surrounding said other travel passageway, means to connect one of said pair of travel passageways to one of the fluid connections, means to connect the other of said pair of travel passageways to the other of the fluid connections and manifold means within the housing to connect said pair of travel passageways to the gerotor cells selectively as the device is operated.

6. The structure of claim 1 or 5 characterized in that the other of said travel passageways is an opening in an end surface of the rotor.

7. In a gerotor hydraulic pressure device having a housing, a rotor with two flat axial end surfaces, a universal drive joint connected to the rotor, gerotor cells and two fluid connections, an improved fluid control comprising a pair of travel passageways, each of said pair of travel passageways extending through the rotor from one surface to the other, one of said pair of travel passageways surrounding the other of said pair of travel passageways, said one of said pair of travel passageways being spaced from the axis of the rotor at both end surfaces of the rotor, means to connect one of said pair of travel passageways to one of the fluid connections, means to connect the other of said pair of travel passageways to the other of the fluid connections and means within the housing to connect said pair of travel passageways to the gerotor cells selectively as the device is operated.

8. In a gerotor hydraulic pressure device having a housing, a rotor with two flat axial end surfaces, a universal drive joint connected to the rotor, gerotor cells and two fluid connections, an improved fluid control comprising a pair of travel passageways, one of said pair of travel passageways extending on a straight line through the rotor from one surface to the other, the other of said pair of travel passageways being in the rotor around the universal drive joint, means to connect one of said pair of travel passageways to one of the fluid connections, means to connect the other of said pair of travel passageways to the other of the fluid connections and means within the housing to connect said pair of travel passageways to the gerotor cells selectively as the device is operated.

9. In a gerotor hydraulic pressure device having a housing, a rotor with two flat axial end surfaces, gerotor cells and two fluid connections, an improved fluid control comprising a pair of travel passageways, each of said pair of travel passageways extending on a straight line through the rotor from one surface to the other, means to connect one of said pair of travel passageways to one of the fluid connections, means to connect the other of said pair of travel passageways to the other of the fluid connections and means within the housing to connect said pair of travel passageways to the gerotor cells selectively as the device is operated.

10. In a gerotor hydraulic pressure device having a housing, a stator, a rotor, the rotor having two flat axial end surfaces, a universal drive joint connected to the rotor, cells and two fluid connections, an improved control comprising a first set of travel passageways, said first set of travel passageways being located in the rotor, said first set of travel passageways extending from one surface to the other surface of the rotor, said first set of travel passageways being spaced from the axis of the rotor at both end surfaces of the rotor, means to connect said first set of travel passageways to one of the two fluid connections, a second set of travel passageways, said second set of travel passageways being located in the rotor, said second set of travel passageways extending from one surface to the other surface of the rotor, said second set of travel passageways being around the universal drive joint, said first set of travel passageways surrounding said second set of travel passageways, means to connect said second set of travel passageways to the other of the two fluid connections, a set of fluid passageways, said set of fluid passageways being located in the housing, each member of said set of fluid passageways having first and second end portions, said first end portion opening into the cells, and said second end portion opening in the zone swept by said travel passageways, said travel passageways selectively communicating with said second end portions as the device is operated.

11. The structure of claim 10 characterized in that said first set of travel passageways extends normal to the surfaces of the rotor and said second set of travel passageways extends normal to the surfaces of the rotor.

12. The structure of claim 10 characterized in that said first set of travel passageways comprises an annular channel, said annular channel being located on one end surface of the rotor, a second annular channel, said second annular channel being located on the other end surface of the rotor, a hole or set of holes, said hole or set of holes being located in the rotor and said hole or set of holes connecting said annular channel to said second annular channel.

13. The structure of claim 10 characterized in that the housing includes a rotor cavity surface and that said means to connect said first set of travel passageways to one of the two fluid connections comprises an annular transfer channel, said annular transfer channel being located on the surface of the rotor cavity, said annular transfer channel opening into the cavity and means to connect said annular transfer channel to one of the two fluid connections.

14. The structure of claim 10 characterized in that said set of fluid passageways are on a manifold in the housing with the manifold having two surfaces and that each comprises a first and a second channel, said first channel being located on one surface of the manifold, said first channel connected to said first end portion opening into the cells, said second channel being located on the other surface of the manifold, said second channel connected to said second end portion opening in the zone of said travel passageways, a hole, and said hole connecting said first channel to said second channel.

15. The structure of claim 14 characterized by the addition of an end plate, said end plate having a surface, said end plate being attached to said manifold and said surface of said end plate enclosing said second channel.

16. In a gerotor hydraulic pressure device having a housing, a stator, a rotor, the rotor having two flat axial end surfaces, cells, a rotor cavity, the rotor cavity having two flat end surfaces, a drive connection driving the rotor in a geared connection in a central bore extending through the rotor and two fluid connections, an improved fluid control comprising a distribution channel, said distribution channel being located in said housing, said distribution channel being connected to one of the two fluid connections, an annular transfer channel, said annular transfer channel being located on one of two surfaces of the rotor cavity, said annular transfer channel opening into the rotor cavity, a set of fluid travelways, said set of fluid travelways being located in the housing connecting said distribution channel to said annular transfer channel, means to connect the central bore of the rotor to the other of the two fluid connections, the housing having first and second sets of openings, said first set of openings being located on the other of the two surfaces of the rotor cavity, said first set of openings communicating into the cells, said second set of openings being located on the other of the two surfaces of the rotor cavity, said second set of openings, opening into the rotor cavity, a set of fluid passageways, said set of fluid passageways being located in said housing, said set of fluid passageways connecting said first set of openings with said second set of openings, respectively, an annular channel, said annular channel being located on one surface of the rotor, said annular channel communicating with said annular transfer channel, a second annular channel, said second annular channel being located on the other surface of the rotor, a hole or set of holes, said hole or set of holes being located in the rotor, said hole or set of holes connecting said annular channel with said second annular channel, a second set of holes, said second set of holes being the gaps and openings in the geared drive connection in the central through bore of the rotor, and said second annular channel and said central through bore of the rotor selectively communicating with said second set of openings as the device is operated to selectively connect the gerotor cells to the fluid connections.

17. The structure of claim 16 characterized in that each of said set of fluid travelways connecting said distribution channel to said annular transfer channel is of a larger diameter at its intersection with said distribution channel than at its intersection with said annular transfer channel.

18. The structure of claim 16 characterized in that said set of fluid passageways connecting said set of openings with said second set of openings are located on a housing manifold having two surfaces and each comprises a first and second channel, said first channel being located on one surface of the manifold, said first channel connected to one of said set of openings, said first channel opening into the cavity of the rotor, said second channel being located on the other surface of the manifold, said second channel being connected to one of said second set of openings, a hole and said hole connecting said first channel to said second channel.

19. The structure of claim 18 characterized by the addition of a manifold plate and an end plate and in that said first and second set of openings and said fluid passageway connecting them are on said manifold plate, said manifold plate having two surfaces, one of said surfaces being the other of the two surfaces of the rotor cavity, said first set of openings being equal in number to the cells, said first set of openings being located on one of the two surfaces of said manifold plate, said set of openings communicating into the cells one opening to one cell respectively, said second set of openings being equal in number to the cells, said second set of openings being located on one of the two surfaces of said manifold plate, said set of openings communicating into the rotor cavity near its central portion, said fluid passageways comprising a first and second set of channels, said first set of channels being equal in number to the cells, said first set of channels being located on one of the two surfaces of said manifold plate, said first set of channels opening into the rotor cavity, each of said first set of channels having two end portions, one end of each of said first set of channels communicating with one of said set of openings, a second set of channels, said second set of channels being equal in number to said cells, said second set of channels being located on the other of the two surfaces of said manifold plate, said end plate having a surface, said end plate being attached to said manifold, said second set of channels being enclosed by said end plate, one end of each of said second set of channels communicating with one of said second set of openings, said manifold plate having a set of holes, said set of holes being equal in number of said cells, said set of holes being located in said manifold and one of said set of holes connecting the other end of one of said set of channels to the other end of one of said second set of channels.

20. The structure of claim 19 characterized by the addition of a pressure plate and said pressure plate being located in said end plate.

21. The structure of claim 19 characterized by the addition of a commutator ring and said commutator ring being located in the rotor around the central through bore.

22. In a gerotor hydraulic pressure device having a housing, a stator, a rotor, the rotor having two flat axial end surfaces, a geared drive connection in a through bore at the center of the rotor, cells and two fluid connections an improved fluid control comprising a first set of travel passageways, said first set of travel passageways being located in the rotor, said first set of travel passageways extending from one surface to the other surface of the rotor, means to connect said first set of travel passageways to one of the two fluid connections, a second set of travel passageways, said second set of travel passageways extending fom one surface to the other surface of the rotor, said second set of travel passageways being the gaps and openings in the geared drive connection, means to connect said second set of travel passageways to the other of the two fluid connections, a set of fluid passageways, said set of fluid passageways being located in the housing, each member of said set of fluid passageways having first and second end portions, said first end portion opening into the cells and said second end portion opening in the zone of said travel passageways so as to selectively communicate with them as the device is operated.

23. The structure of claim 24 characterized in that said means to connect said first set of travel passageways to one of the two fluid connections comprises a distribution channel, said distribution channel being located in said housing, said distribution channel being connected to one of the two fluid connections, an annular transfer channel, said annular transfer channel being located on one of the two surfaces of the rotor cavity, said annular transfer channel opening into the rotor cavity, a set of fluid travelways, said set of fluid travelways being located in the housing connecting said distribution channel to said annular transfer channel, and said annular transfer channel communicating with said first set of travel passageways.

24. The structure of claim 22 characterized in that said set of fluid passageways each comprises a first and second channel, said first channel being located on one surface of the manifold, said first channel opening into the cavity of the rotor, said second channel being located on the other surface of the manifold, a hole and said hole connecting said channel to said second channel.

25. In a gerotor hydraulic pressure device having a housing, a stator, a rotor, the rotor having two flat axial end surfaces, a geared drive connection at the center of the rotor, gerotor cells, a set of manifold passageways in said housing communicating with the gerotor cells, and two fluid connections, an improved fluid control comprising a first travel passageway, said first travel passageway being a series of holes, said first travel passageway being located in the rotor, said first travel passageway extending from one surface to the other surface of the rotor, said first travel passageway being spaced from the axis of the rotor at both end surfaces of the rotor, commutation means to connect said first travel passageway to one of the two fluid connections, a second travel passageway, said second travel passageway being located in the rotor, said first travel passageway surrounding said second travel passageway, and means to connect said second travel passageway to the other of the two fluid connections, said travel passageways selectively communicating with the set of manifold passageways in the housing as the device is operated.

26. The gerotor hydraulic pressure device of claim 25 characterized in that said second travel passageway comprises the gaps and openings in the geared drive connection.

27. The gerotor hydraulic pressure device of claim 25 wherein the housing has a rotor facing surface and said commutation means to connect said first travel passageway to one of the two fluid connections includes a commutation ring channel, said commutation ring channel being on one of the rotor facing surface of the housing or the axial end surface of the rotor facing such rotor facing surface of the housing.

28. The gerotor hydraulic pressure device of claim 27 characterized by said commutation means also including a ring channel, said ring channel being on the other of the rotor facing surface of the housing or the axial end surface of the rotor facing such rotor facing surface of the housing, said commutation ring channel commuting with said ring channel.

29. The gerotor hydraulic pressure device of claim 25 characterized by the addition of a ring channel on one flat surface of the rotor and another ring channel on the other flat surface of the rotor, and said first travel passageway connecting said ring channel to said another ring channel.

30. The gerotor hydraulic pressure device of claim 29 wherein the housing has a rotor facing surface and characterized by the further addition of said commutation means to connect said first travel passageway to one of the two fluid connections including a commutation ring channel, said commutation ring channel being on the rotor facing surface of the housing, said commutation ring channel commuting with said ring channel.

31. The gerotor hydraulic pressure device of claim 29 characterized in that said ring channels being of substantially similar surface area.

32. The structure of claim 25 or 28 characterized in that said second travel passageway extends from one end surface to the other end surface of the rotor.

33. The structure of claim 25 or 28 characterized in that said second travel passageway is an opening in an end surface of the rotor.

34. A gerotor hydraulic pressure device having a housing, a stator, a rotor, the rotor having two flat axial end surfaces, a geared drive connection at the center of the rotor, gerotor cells, a set of manifold passageways in said housing communicating with the gerotor cells and two fluid connections, an improved fluid control comprising an annular channel, said annular channel being in one flat surface of the rotor, said annular channel being spaced from the axis of the rotor, a second annular channel, said second annular channel being in the other flat surface of the rotor, said second annular channel being spaced from the axis of the rotor, at least one hole through the rotor connecting said annular channel to said second annular channel, commutation means to connect said annular channel to one of the two fluid connections, a travel passageway being located in the rotor, one of said annular channel or said second annular channel surrounding said travel passageway, and means to connect said travel passageway to the second of the two fluid connections, said second annular channel and said travel passageways selectively communicating with the set of manifold passageways in said housing as the device is operated.

35. In a gerotor hydraulic pressure device having a housing, a stator, a rotor, the rotor having two flat axial end surfaces, a universal drive joint connected to the rotor, gerotor cells, a set of manifold passages in the housing communicating with the cells and two fluid connections, an improved control comprising a first set of travel passageways, said first set of travel passageways extending from one end surface to the other end surface of the rotor, said first set of travel passageways being spaced from the axis of the rotor at both end surfaces of the rotor, means to connect said first set of travel passageways to one of the two fluid connections, a second travel passageway, said second travel passageway being an opening in a flat surface of the rotor, said first set of travel passageways surrounding said second travel passageway, and means to connect said second travel passageway to the other of the two fluid connections, said travel passageways selectively communicating with the set of manifold passageways as the device is operated.

36. The gerotor hydraulic pressure device of claim 35 characterized in that first set of travel passageways comprises an annular channel, said annular channel being located on one flat surface of the rotor, a second annular channel, said second annular channel being located on the other flat surface of the rotor, and at least one hole through the rotor connecting said annular channel to said second annular channel.

37. In a gerotor hydraulic pressure device having a housing, the housing having two rotor facing flat surfaces, a stator, a rotor, the rotor having two flat axial end surfaces, a geared drive connection at the center of the rotor, gerotor cells, a set of manifold passages in the housing communicating with the gerotor cells and two fluid connections, an improved fluid control comprising a first travel passageway, said first travel passageway being a series of holes, said first travel passageway being located in the rotor, said first travel passageway extending from one end surface to the other end surface of the rotor, said first travel passageway being spaced from the axis of the rotor at both end surfaces of the rotor, first commutation means to connect said first travel passageway to one of the two fluid connections, a second travel passageway, said second travel passageway being located in the rotor, said second travel passageway being an opening in a surface of the rotor, said first travel passageway surrounding said second travel passageway, and second commutation means to connect said second travel passageway to the second of the two fluid connections, said travel passageways selectively communicating with the set of manifold passageways as the device is operated.

38. The structure of claim 37 characterized in that said second commutation means is on the opposite side of the rotor from said first commutation means.

39. The gerotor hydraulic pressure device of claim 37 wherein the opening of said second travel passageway has a surface area and characterized by the addition of a balancing ring channel, said balancing ring channel being in the surface of the rotor on the opposite side of the rotor from said opening, said balancing ring channel having a surface area substantially equal to said surface area of said opening, and means through the rotor to connect said opening with said balancing ring channel, said balancing ring channel equalizing the pressures on the opposing sides of the rotor.

40. The gerotor hydraulic pressure device of claim 37 wherein the housing has a rotor facing piece and said second communication means to connect said second travel passageway to the second of the two fluid connections includes a hole, said hole being through the rotor facing piece of the housing.

41. The gerotor hydraulic pressure device of claim 37 wherein the housing has a rotor facing surface and said first commutation means to connect said first travel passageway to one of the two fluid connections includes a commutation ring channel, said commutation ring channel being on one of the rotor facing surface of the housing or the axial end surface of the rotor facing such rotor facing surface of the housing.

42. The gerotor hydraulic pressure device of claim 41 characterized by said first commutation means also including a ring channel, said ring channel being on the other of the rotor facing surface of the housing or the axial end surface of the rotor facing such rotor facing surface of the housing, said first commutation means commuting with said ring channel.

43. The gerotor hydraulic pressure device of claim 37 characterized by said first travel passageway being at least one hole and by the addition of an annular channel on one flat surface of the rotor and a second annular channel on the other flat surface of the rotor, one of said annular channels surrounding said opening, and said first travel passageway connecting said annular channel to said second annular channel.

44. The gerotor hydraulic pressure device of claim 43 characterized in that said ring channels are of substantially similar surface area.

45. The gerotor hydraulic pressure device of claim 43 wherein the housing has a rotor facing surface and characterized by the further addition of said first commutation means to connect said first travel passageway to one of the two fluid connections includes a commutation ring channel, said first commutation ring channel being on the rotor facing surface of the housing, said first commutation ring channel commuting with said annular channel.

46. In a gerotor hydraulic pressure device having a housing having two rotor facing walls, a stator, a rotor, the rotor having two flat axial end surfaces, a geared drive connection at a partial through bore in the center of a flat end surface of the rotor, gerotor cells, a set of manifold passages in the housing communicating with the gerotor cells and two fluid connections, an improved fluid control comprising an annular channel, said annular channel being in one end surface of the rotor, said annular channel being spaced from the axis of the rotor, a hole or series of holes, said hole or series of holes extending from said annular channel to the other end surface of the rotor, said hole or series of holes joining the other end surface of the rotor substantially at the intersection of the other end surface of the rotor and the partial through bore therein, said hole or series of holes being spaced from the axis of the rotor at said intersection, commutation means in one rotor facing wall of the housing to connect said hole or series of holes to one of the two fluid connections, an opening, said opening being in said one end surface of the rotor, said annular channel surrounding said opening, second commutation means in the other rotor facing wall of the housing to connect said opening to the other of the two fluid connections, said annular channel and said opening selectively communicating with the set of manifold passageways as the device is operated.

47. The gerotor hydraulic pressure device of claim 46 characterized in that said hole or series of holes extend linearly through the rotor.

48. The gerotor hydraulics pressure device of claim 46 wherein said opening has a surface area and characterized by the addition of a balancing opening, said balancing opening being in the other end surface of the rotor on the opposite side of the rotor from said opening, said balancing opening having a surface area substantially equal to said surface area of said opening and a hole or series of holes through the rotor to connect said opening with said balancing opening, said balancing opening equalizing the pressures on opposing sides of the rotor.

49. The gerotor hydraulic pressure device of claim 48 wherein said balancing opening is a ring channel and said ring channel surrounding said partial through bore.

* * * * *